US009464429B2

(12) United States Patent
Johnson

(10) Patent No.: US 9,464,429 B2
(45) Date of Patent: Oct. 11, 2016

(54) WATERPROOFING SYSTEM FOR WET AREAS

(71) Applicant: Stephen Johnson, Narrabri (AU)

(72) Inventor: Stephen Johnson, Narrabri (AU)

( * ) Notice: Subject to any disclaimer, the term of this patent is extended or adjusted under 35 U.S.C. 154(b) by 0 days.

(21) Appl. No.: 14/425,386

(22) PCT Filed: Jul. 25, 2013

(86) PCT No.: PCT/AU2013/000828

§ 371 (c)(1),
(2) Date: Mar. 3, 2015

(87) PCT Pub. No.: WO2014/036590

PCT Pub. Date: Mar. 13, 2014

(65) Prior Publication Data

US 2015/0252561 A1 Sep. 10, 2015

(30) Foreign Application Priority Data

Sep. 5, 2012 (AU) ..... 2012903862
Nov. 29, 2012 (AU) ..... 2012101755
Apr. 11, 2013 (AU) ..... 2013204009

(51) Int. Cl.
*E04B 1/68* (2006.01)
*E04F 19/04* (2006.01)
*E04F 13/073* (2006.01)
*A47K 3/00* (2006.01)

(52) U.S. Cl.
CPC ..... *E04B 1/68* (2013.01); *A47K 3/008* (2013.01); *E04F 13/0733* (2013.01); *E04F 19/04* (2013.01); *E04F 19/045* (2013.01)

(58) Field of Classification Search
None
See application file for complete search history.

(56) References Cited

U.S. PATENT DOCUMENTS 1,939,115 A * 12/1933 Fritsche ..... 52/35
2,031,255 A * 2/1936 Deubelbeiss ..... 52/35
2,178,501 A * 10/1939 Staneampiano ..... E04F 19/045 52/241
2,526,883 A * 10/1950 La Barre ..... A47K 3/16 4/538
2,752,609 A * 7/1956 Phelps ..... 248/27.1
2,757,385 A * 8/1956 Whittick ..... 4/613
3,134,197 A * 5/1964 McColley ..... 52/35
3,182,767 A * 5/1965 Kuehl ..... 52/272
3,457,568 A * 7/1969 Amatruda ..... 4/613

(Continued)

FOREIGN PATENT DOCUMENTS

DE 202011052389 U1 * 3/2013 ..... A47K 3/008
GB 1001781 A * 8/1965 ..... E04F 19/04

OTHER PUBLICATIONS

Selected documents related to Supplementary European search report for corresponding application 13836078.9 (May 2016; 6 pages).*

(Continued)

*Primary Examiner* — Rodney Mintz
(74) *Attorney, Agent, or Firm* — Harness, Dickey & Pierce, P.L.C.

(57) ABSTRACT

The present invention relates generally to a waterproofing assembly (10) for a wet area such as a shower recess (12). The waterproofing assembly (10) comprises an elongate spacer element (24) and a waterproofing membrane or coating (26). The spacer element (24) is adapted to secure to a wall structure (14) which is associated with a wall panel (28). The wall panel (28) rests upon the spacer element (24) to raise the panel (28) above the level of a floor (16) and substantially clear of the wet area (12). The wall panel (28) is otherwise conventionally fixed to the wall structure (14).

13 Claims, 2 Drawing Sheets

(56) References Cited

U.S. PATENT DOCUMENTS 3,574,869 A * 4/1971 Skyhawk ..... A47K 3/40 4/614
3,588,925 A * 6/1971 Kuypers ..... 4/595
3,638,372 A * 2/1972 Rosenthal ..... E06B 7/14 49/476.1
4,265,064 A * 5/1981 Parezo ..... 52/302.3
4,488,386 A * 12/1984 Thompson ..... 52/169.1
4,825,480 A * 5/1989 Moore ..... 4/595
4,829,731 A * 5/1989 Schluter ..... E04F 19/049 52/287.1
4,879,858 A * 11/1989 Murdoch ..... 52/741.4
4,907,385 A * 3/1990 Biodrowski ..... 52/302.3
5,027,572 A * 7/1991 Purcell et al. ..... 52/309.9
5,159,723 A * 11/1992 Benedict ..... A47K 3/008 4/538
5,203,640 A * 4/1993 Pourtau et al. ..... 403/403
5,218,793 A * 6/1993 Ball ..... 52/62
5,243,798 A * 9/1993 Elliott ..... 52/273
5,243,799 A * 9/1993 Schluter ..... 52/282.1
5,289,663 A * 3/1994 Schluter ..... 52/287.1
5,398,471 A * 3/1995 Spagnolo ..... 52/412
5,495,696 A * 3/1996 Repka ..... 52/169.5
5,694,723 A * 12/1997 Parker ..... 52/169.5
5,778,464 A * 7/1998 Chapple et al. ..... 4/596
5,911,518 A * 6/1999 Jurek et al. ..... 4/596
5,950,370 A * 9/1999 Peck ..... 52/35
6,293,064 B1 * 9/2001 Larson ..... E04B 1/762 52/209
6,308,470 B1 * 10/2001 Durkovic ..... 52/169.5
6,419,238 B2 * 7/2002 McComb ..... 277/630
6,460,305 B1 * 10/2002 VanHaitsma et al. ..... 52/483.1
6,634,144 B1 * 10/2003 Moore et al. ..... 52/169.5
6,948,287 B2 * 9/2005 Korn ..... 52/393
7,246,472 B2 * 7/2007 Nielsen ..... 52/302.3
7,421,826 B2 * 9/2008 Collins et al. ..... 52/302.1
7,634,883 B1 * 12/2009 Larson et al. ..... 52/573.1
7,735,271 B1 * 6/2010 Shipston et al. ..... 52/169.11
2002/0152693 A1 * 10/2002 Krogstad ..... 52/58
2005/0210772 A1 * 9/2005 Janesky ..... 52/168
2006/0156641 A1 * 7/2006 Takagi ..... E04B 1/70 52/62
2007/0022683 A1 * 2/2007 McGee ..... E04B 2/7457 52/270
2007/0062137 A1 * 3/2007 Maylon ..... E04F 13/06 52/367
2008/0016808 A1 * 1/2008 Pilz ..... 52/302.6
2009/0183445 A1 * 7/2009 Mcpherson ..... E02D 31/02 52/169.5
2010/0154112 A1 * 6/2010 Goodhue ..... 4/613
2010/0281612 A1 * 11/2010 Cook ..... A47K 3/008 4/614
2010/0325969 A1 * 12/2010 Hourihan ..... 52/35
2011/0041426 A1 * 2/2011 Trotter ..... 52/169.5
2014/0360109 A1 * 12/2014 Goldberg ..... E04B 1/70 52/169.5
2016/0040433 A1 * 2/2016 Sawada ..... E04F 13/085 52/506.05

OTHER PUBLICATIONS

International Search Report for PCT/AU2013/000828, mailed Oct. 14, 2013; ISA/AU.

* cited by examiner

WATERPROOFING SYSTEM FOR WET AREAS

CROSS-REFERENCE TO RELATED APPLICATIONS

This application is a 371 U.S. National Stage of International Application No. PCT/AU2013/000828, filed on Jul. 25, 2013, which claims priority to Australian Patent Application Nos. 2012903862, filed on Sep. 5, 2012; 2012101755, filed on Nov. 29, 2012; and 2013204009, filed on Apr. 11, 2013. The entire disclosures of the above applications are incorporated herein by reference.

FIELD OF THE INVENTION

The present invention relates broadly to a waterproofing assembly for a wet area such as that experienced in a bathroom or laundry. The invention also relates generally to a method of waterproofing a wet area.

BACKGROUND TO THE INVENTION

It is important to appropriately waterproof wet areas, such as a shower recess, to avoid water penetrating behind or under wall cladding or flooring. If not adequately waterproofed the wall cladding, such as plasterboard, can retain moisture and swell dislodging exposed floor or wall tiles. The most common technique to address this potential problem involves the application of a waterproof membrane to vulnerable wet areas. Generally a flexible sealant is also used in corner regions inside the waterproof membrane and around where the plasterboard wall adjoins the floor. Rigid flashing may also be used to supplement the waterproof membrane and the flexible sealant where the flashing sits in behind the plasterboard wall. These forms of waterproofing are applied prior to laying of a mortar bed and tiling of the wet area.

SUMMARY OF THE INVENTION

According to one aspect of the present invention there is provided an elongate spacer element of a waterproofing assembly for a wet area including a wall structure adjacent a floor, said spacer element adapted to secure to the wall structure associated with a wall panel which rests upon the spacer element to raise the wall panel above the level of the floor and substantially clear of the wet area.

According to another aspect of the invention there is provided a waterproofing assembly for a wet area including a wall structure adjacent a floor, said assembly comprising:

- an elongate spacer element located at least partly within the wet area and adapted to secure to the wall structure associated with a wall panel, the spacer element including an elongate board of a thickness substantially equal to the thickness dimension of the wall panel which with the elongate board secured to the wall structure and resting on the floor rests upon the elongate board to raise the wall panel above the level of the floor and substantially clear of the wet area;
- a waterproofing membrane or coating applied to at least adjoining surfaces of the wall panel and the spacer element to seal at least the juncture between said panel and the spacer element.

Preferably the spacer element also includes a lower flange extending from a lower inside edge of the board and having a thickness less than the thickness of the board, the flange adapted to contact the floor for sealing along a lower region of the spacer element. More preferably the spacer element further includes an upper flange extending from an upper inside edge of the board and adapted to contact an inside face of the wall panel for an effective seal between said panel and the upper flange. Still more preferably the elongate board defines a ledge on its upper surface adjacent the upper flange, the ledge being adapted to provide a rest for the wall panel.

Preferably the waterproofing assembly also comprises a flashing strip arranged to cooperate with the spacer element on its exposed outer face and adapted to contact the floor for additional sealing of the spacer element. More preferably the flashing strip locates within a groove in the outer face of the spacer board. Even more preferably the flashing strip is in the form of an angle section having its upper web partly inserted into the groove. Still more preferably the angle section includes a lower web connected to and extending from the upper web at an obtuse angle, the lower web adapted to contact the floor for additional sealing along the lower region of the spacer element.

Preferably the waterproofing assembly further comprises a bond breaker located within the obtuse angle of the angle section and enclosed by the waterproofing membrane. Alternately the bond breaker is formed integral with the flashing strip.

Preferably the waterproofing assembly still further comprises a skirting element mounted to the spacer element with the waterproofing membrane or coating therebetween. More preferably the skirting element includes a plurality of skirting tiles. Alternatively the skirting element is in the form of an elongate skirting board.

Preferably the waterproofing membrane includes a fibreglass mat or tape with an associated resin. Alternately or additionally the waterproofing membrane includes a polymeric coating.

Preferably the waterproofing assembly additionally comprises a liquid sealant applied to an exposed face of the lower flange for sealing with the floor. More preferably the liquid sealant is also applied to the upper flange for sealing with the wall panel.

According to a further aspect of the invention there is provided a method of waterproofing a wet area including a wall structure adjacent a floor, said method comprising the steps of:

- securing an elongate spacer element to the wall structure associated with a wall panel, the spacer element including an elongate board of a thickness substantially equal to the thickness dimension of the wall panel and secured to the wall structure so that it rests upon the floor;
- locating the wall panel upon the elongate board to raise it above the level of the floor and substantially clear of the wet area;
- applying a waterproofing membrane or coating to at least a juncture defined between adjoining surfaces of the wall panel and the board to seal the juncture between said panel and the board.

Preferably the method further comprises the step of applying a liquid sealant to either or both:

i) an exposed outer face of a lower region of the elongate board for sealing with the floor;

ii) an upper region of the board for sealing with the wall panel.

Preferably the method still further comprises the step of adjusting a lower edge of the elongate board to maintain substantially continuous contact with the floor. More preferably the step of adjusting the lower edge involves trimming or cutting the lower edge to compensate for variations in the level or contour of the floor.

Preferably the method still further comprises the step of applying a flashing strip to an exposed outer face of the spacer element, the flashing strip adapted to contact the floor for additional sealing of the spacer element.

Preferably the elongate spacer element is formed of a plastics material. More preferably the spacer element is extruded in a plastics material.

Preferably the wall panel is a plasterboard wall panel.

Generally the elongate spacer element is formed in one-piece.

BRIEF DESCRIPTION OF THE DRAWINGS

In order to achieve a better understanding of the nature of the present invention a preferred embodiment of a waterproofing assembly for a wet area will now be described, by way of example only, with reference to the accompanying drawings in which.

DETAILED DESCRIPTION OF THE PREFERRED EMBODIMENTS

Figure 1:
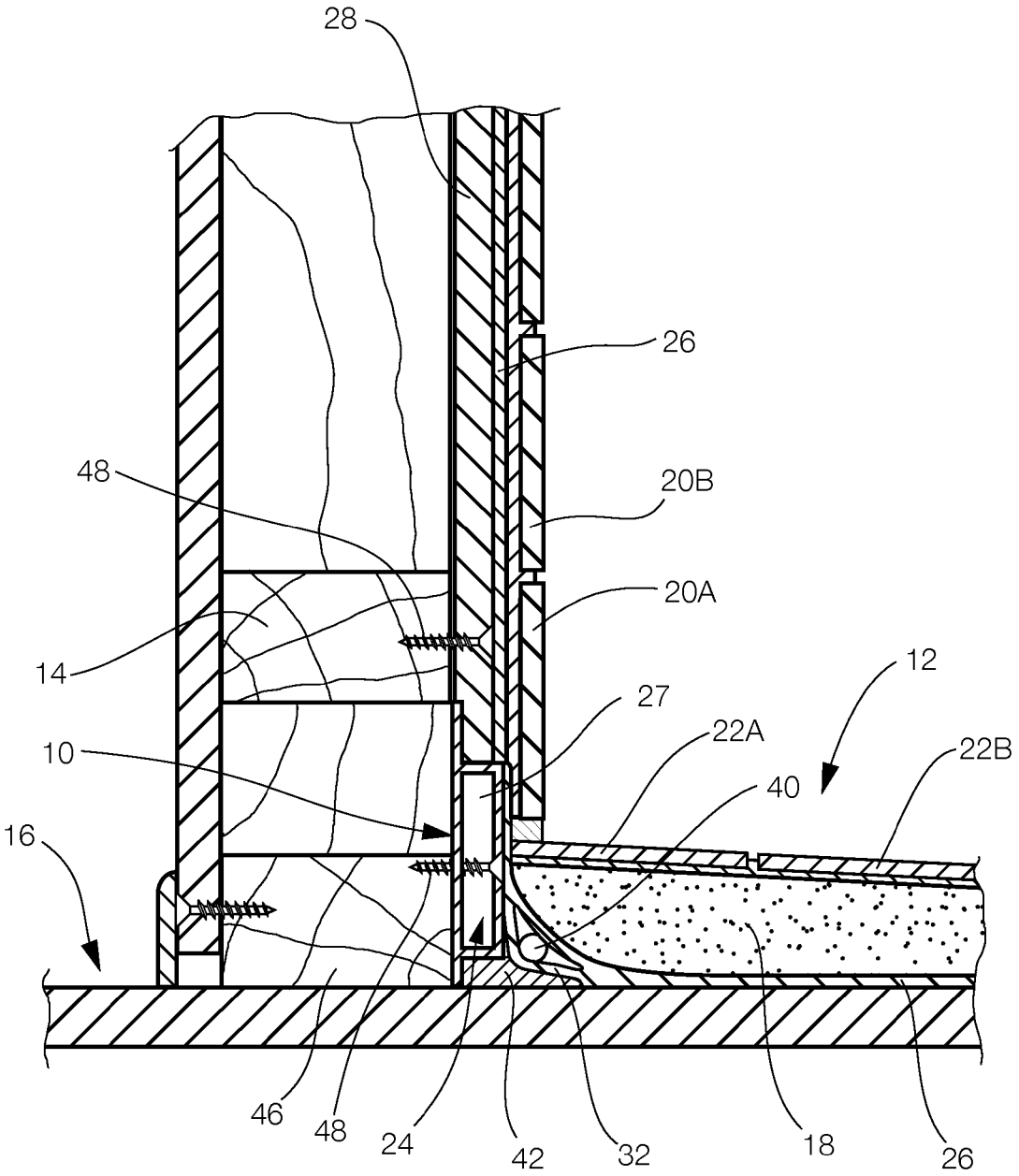
FIG. 1 is a schematic sectional view of a waterproofing assembly of one embodiment of the invention installed in a wet area.

As best shown in FIG. 1 there is a waterproofing assembly designated generally as 10 for a wet area such as shower recess 12. The wet area 12 includes a wall structure 14 adjacent a floor 16. The shower recess 12 of this example includes a mortar bed 18 applied to the floor 16. The wall structure 14 is clad on its exposed surface with wall tiles such as 20A and 20B and the mortar bed 18 is similarly clad on its interior exposed surface with floor tiles such as 22A and 22B.

It will be understood that the wet area such as the shower recess 12 may be located elsewhere in a bathroom, laundry or other area likely to accumulate water. The wall or floor cladding is not limited to tiles but may extend to other forms of exposed cladding such as wooden or composite skirting board. The floor need not be clad but may for example consist of a finished concrete or other cementitious surface.

Figure 2:
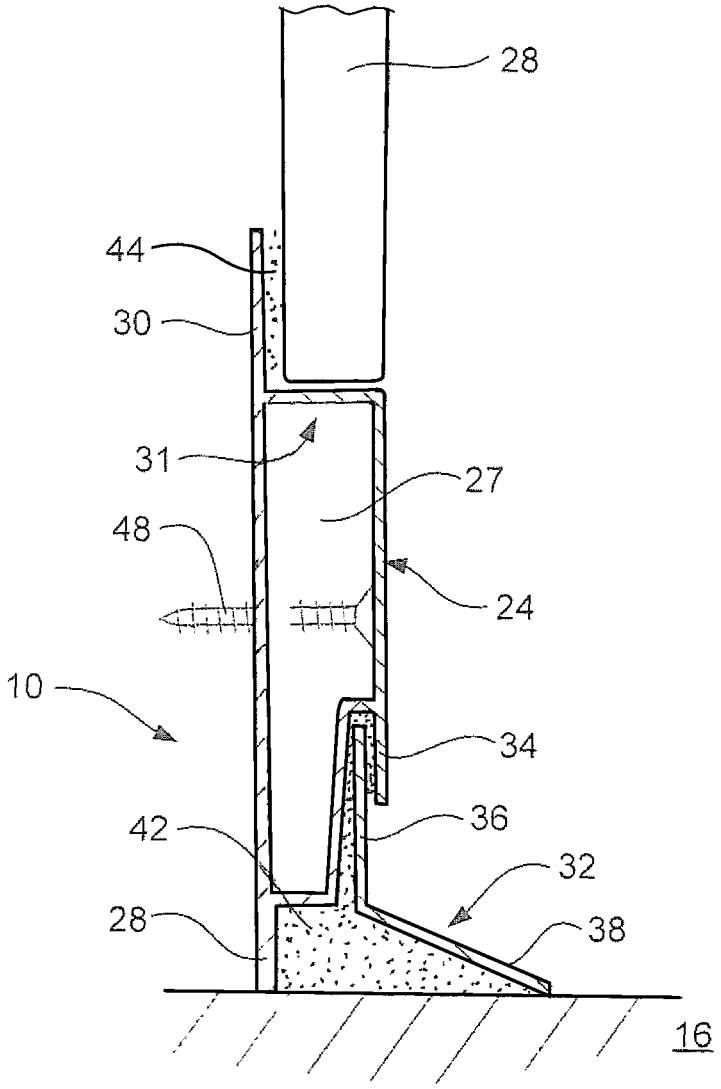
FIG. 2 is an enlarged sectional view of an elongate spacer element taken from the waterproofing assembly of FIG. 1 together with an associated flashing strip.

As shown in FIGS. 1 and 2 the waterproofing assembly 10 of this embodiment comprises an elongate spacer element 24 and a waterproofing membrane or coating 26. The spacer element 24 is adapted to secure to the wall structure 14 which is associated with a wall panel 28. The wall panel 28 rests upon the spacer element 24 to raise the wall panel 28 above the level of the floor 16 and substantially clear of the wet area 12. The wall panel 28 is otherwise conventionally fixed to the wall structure 14. The waterproofing membrane 26 is applied to at least adjoining surfaces of the wall panel 28 and the spacer element 24.

In this example the elongate spacer element 24 includes an elongate board 27 of a thickness substantially equal to the general thickness of the wall panel 28. The board 27 in effect provides a continuation of the wall panel 28 in the wet area. The spacer element 24 also includes a lower flange 28 extending from a lower edge of the board 27. The lower flange 28 is of a thickness significantly less than the thickness of the board 27 and is adapted to rest on or contact the floor 16 for sealing along a lower region of the spacer element 24. The spacer element 24 further includes an upper flange 30 extending from an upper inside edge of the board 27. The upper flange 30 is thus located flush with the board 27 and parallel to the lower flange 28. The upper flange 30 is adapted on an inside face to contact the wall panel 28 for an effective seal between the panel 28 and the upper flange 30. The elongate board 27 thus includes a ledge 31 along its upper surface adjacent the upper flange 30. The wall panel 28 rests upon the ledge 31. The upper flange 30 also provides for rigidity between studs of the wall structure 14.

In this embodiment the waterproofing assembly 10 also comprises a flashing strip 32. The flashing strip 32 is arranged to co-operate with the spacer element 24 on its exposed outside face and adapted to contact the floor 16 for additional seal of the spacer element 24. The board 27 includes a groove 34 in its exposed face in which the flashing strip 32 locates. In this example the flashing strip 32 is in the form of an angle section having its upper web 36 partly inserted into the groove 34. The lower web 38 of the angle section flashing strip 32 is adapted to contact the floor for additional sealing along the lower region of the spacer element 24. The upper web 36 is connected to and extends from the lower web 38 at an obtuse angle, at around 110°.

The waterproofing assembly such as 10 may depending on the application also comprise a bond breaker such as 40 located within the obtuse angle of the angle section of the flashing strip 32. The bond breaker 40 is enclosed by the waterproofing membrane 26 which extends between the elongate board 27 and the adjacent flooring 16 within the wet area 12. The bond breaker 40 may be separate from or formed integral with the flashing strip 32.

The waterproofing assembly 10 additionally comprises a liquid sealant such as 42 applied to an exposed face of the lower flange 28 for sealing with the floor 16. This sealant 42 seals adjoining surfaces of the elongate board 27, or more particularly the lower flange 28, and the floor 16, and also extend underneath the flashing strip 32 to improve its seal with the floor 16. It is also possible that additional liquid sealant 44 may be applied to an outer face of the upper flange 30 of the spacer element 24 for sealing with the wall panel 28.

The waterproofing membrane 26 of this example includes a fibreglass mat or tape with an associated resin. The membrane 26 may alternatively or additionally include a polymeric coating (not shown).

The elongate spacer element 24 is typically formed in one-piece as for example a plastics moulded or extruded product. The flashing strip such as 32 may also be formed in a plastics moulded or extruded product either separate from or integral with the bond breaker such as 40. The spacer element 24 is preferably impervious to and resistant to water so that if exposed to water in the wet area it is not damaged. The waterproofing assembly 10 of this embodiment thus has two (2) lines of defence to water in the wet area. The first line of defence is provided by the waterproofing membrane 26 and the second line is provided by the spacer element 24.

The wall panel 28 of this embodiment is a plasterboard wall panel such as that manufactured and sold under the trade mark Gyprock®. It should be understood however that the wall panel extends to other lining materials such as render or plaster material or face brick work.

In order to better understand the invention a preferred embodiment of a method of waterproofing a wet area such as that described in the previous embodiment will be described herein. The general steps involved in the method of waterproofing include:

1. Securing an elongate spacer element such as an elongate board 24 to a wall structure such as 14 associated with a wall panel such as 28;
2. Locating the wall panel 28 upon the spacer element 24 to raise it above the level of the floor such as 16 and substantially clear of the wet area such as 12.

In this example the spacer element 24 is directly screw fastened to a bottom plate such as 46 of the wall structure 14 via a screw fastener such as 48. The spacer element 24 is fastened to the bottom plate 46 with the lower flange 28 resting or pressed firmly against the floor 16. The lower flange 28 may be trimmed or cut to compensate for variations in the level of the floor 16 for substantially continuous contact with the floor 16. This adjustment of the lower flange 28 of the spacer element 24 may also ensure that it is oriented substantially level.

In this embodiment the step of locating the wall panel 28 upon the spacer element 24 involves resting the wall panel 28 upon the ledge 31 of the spacer element 24. The panel 28 typically includes an edge rebate which sits inside the ledge 31 of the spacer element 24. This means the outer face of the elongate board 27 is flush with the exposed face of the wall panel 28. The edge rebate can be filled with plaster or additional of the waterproofing membrane 26.

The method of this embodiment further comprises the step of applying the flashing strip such as 32 to an exposed face of the spacer element 24. The flashing strip 32 locates within the groove 34 of the elongate board 27 and is adapted to rest upon or contact the floor for additional sealing of the spacer element 24. The flashing strip such as 32 is preferably fabricated of a flexible material to ensure substantially continuous contact with the floor 16. The spacer element may also be sealed to the floor 16 via a layer of liquid sealant such as 42 applied prior to installation of the flashing strip 32. The liquid sealant 42 may also promote sealing of the flashing strip 32 to the floor 16.

The method may also comprise the application of liquid sealant such as 44 to an outer surface of the upper flange 30 of the spacer element 24 for additional sealing with the wall panel such as 28. This liquid sealant 44 is designed to prevent the ingress of liquid beyond adjoining surfaces of the spacer element 24 and the wall panel 28.

The wet area such as 12 in this embodiment of the invention is then waterproofed by the application of a waterproofing membrane such as 26. The waterproofing membrane 26 depending on the specific application and waterproofing requirements is applied in a substantially continuous length to the wall panel 28 in its lower regions, the adjoining exposed surface of the elongate spacer element 24, the flashing strip 32 (which is optional) and the adjoining floor 16. If the waterproofing assembly such as 10 includes the bond breaker 40 the waterproofing membrane 26 also covers the bond breaker 40. The waterproofing membrane 26 otherwise effectively encloses the elongate spacer element 24 and its associated sealing elements. The wet area such as 12 is then clad or surfaced in an otherwise traditional manner, for example tiling with an appropriate tile adhesive.

The waterproofing assembly such as 10 also lends itself to installation in corner regions (not illustrated). In this application a pair of the elongate boards and their associated components abut or otherwise adjoin one another in the corner region. Additional sealing may be applied to the waterproofing assembly in the corner region by the application of liquid sealant and/or additional flashing. The additional flashing may take the form of angle section strip positioned vertically on inside and/or outside surfaces of the adjoining elongate boards.

Now that a preferred embodiment of the present invention has been described, it will be apparent to those skilled in the art that the waterproofing assembly has at least the following advantages:

1. The waterproofing assembly effectively raises a wall panel substantially clear of the wet area where it is vulnerable to water damage;
2. The spacer element of the waterproofing assembly in effect forms a continuation of the wall panel and integrates both dimensionally and functionally without having to depart significantly from existing building techniques;
3. The waterproofing assembly can be installed with relative ease by for example screw fixing to existing wall structure such as a bottom plate or wall nogging.

Those skilled in the art will appreciate that the invention described herein is susceptible to variations and modifications other than those specifically described. For example, the dimensions of the spacer element may vary from that illustrated provided it functions as broadly defined. The spacer element may be hollow or solid. The waterproofing assembly and it various components are not restricted to the materials of construction described where for example the spacer element may be fabricated from metal. The flashing strip should it be used may also be formed or fabricated integral with the spacer element. All such variations and modifications are to be considered within the scope of the present invention the nature of which is to be determined from the foregoing description.

The invention claimed is:

1. A waterproofing assembly at an interior wet area including a wall structure adjacent a floor, said assembly comprising:

an elongate spacer element located at least partly within the wet area and adapted to secure to the wall structure associated with a wall panel such that the elongate spacer element directly rests on the floor, the elongate spacer element being moulded or extruded in plastics and including;

i) an integrally formed elongate board portion having a rear surface directly secured to the wall structure via a fastener penetrating said elongate board portion which is of a thickness substantially equal to the thickness dimension of the wall panel, the elongate board portion adapted to support the wall panel to raise the wall panel above the level of the floor and substantially clear of the wet area;

ii) a lower flange extending directly from a lower inside edge of the elongate board portion substantially flush with the rear face of the elongate board portion and having a thickness less than the thickness of the elongate board portion, the lower flange adapted to contact the floor and the wall structure for sealing along a lower region of the elongate spacer element; and iii) a waterproofing membrane or coating covering at least a juncture defined between adjoining surfaces of the wall panel and the elongate board portion to seal the juncture between said wall panel and the elongate board portion.

2. The waterproofing assembly as defined in claim 1 wherein the waterproofing membrane includes a fibreglass mat or tape with an associated resin.

3. The waterproofing assembly as defined in claim 1 wherein the waterproofing membrane includes a polymeric coating.

4. The waterproofing assembly as defined in claim 1 further comprising a skirting element mounted to the elongate spacer element with the waterproofing membrane or coating therebetween.

5. The waterproofing assembly as defined in claim 4 wherein the skirting element includes a plurality of skirting tiles or is in the form of an elongate skirting board.

6. The waterproofing assembly as defined in claim 1 wherein the elongate spacer element further includes an upper flange extending from an upper edge of the rear surface of the elongate board portion and adapted to contact an inside face of the wall panel for an effective seal between said wall panel and the upper flange, the elongate board portion defining a ledge on an upper surface thereof adjacent the upper flange, the ledge being adapted to provide a rest for the wall panel.

7. The waterproofing assembly as defined in claim 6 also comprising a liquid sealant applied to an exposed face of the lower flange for sealing with the floor.

8. The waterproofing assembly as defined in claim 7 wherein the liquid sealant is also applied to the upper flange for sealing with the wall panel.

9. The waterproofing assembly as defined in claim 1 also comprising a flashing strip arranged to cooperate with the elongate spacer element on an exposed outer face thereof and adapted to contact the floor for additional sealing of the elongate spacer element.

10. The waterproof assembly as defined in claim 9 wherein the flashing strip locates within a groove in an outer face of the elongate board portion.

11. The waterproof assembly as defined in claim 10 wherein the flashing strip is in the form of an angle section having an upper web that is partly inserted into the groove.

12. The waterproofing assembly as defined in claim 11 wherein the angle section includes a lower web connected to and extending from the upper web at an obtuse angle, the lower web adapted to contact the floor for additional sealing along a lower region of the elongate spacer element.

13. The waterproofing assembly as defined in claim 11 further comprising a bond breaker located within the obtuse angle of the angle section and enclosed by the waterproofing membrane.

* * * * *